US009437121B2

(12) United States Patent
Murphy

(10) Patent No.: US 9,437,121 B2
(45) Date of Patent: Sep. 6, 2016

(54) CARD HOLDER

(76) Inventor: Aidan Murphy, Belfast (GB)

( * ) Notice: Subject to any disclaimer, the term of this patent is extended or adjusted under 35 U.S.C. 154(b) by 23 days.

(21) Appl. No.: 13/984,379

(22) PCT Filed: Feb. 8, 2012

(86) PCT No.: PCT/EP2012/052140

§ 371 (c)(1),
(2), (4) Date: Aug. 8, 2013

(87) PCT Pub. No.: WO2012/107496

PCT Pub. Date: Aug. 16, 2012

(65) Prior Publication Data

US 2013/0313397 A1 Nov. 28, 2013

Related U.S. Application Data

(60) Provisional application No. 61/469,290, filed on Mar. 30, 2011.

(30) Foreign Application Priority Data

Feb. 8, 2011 (GB) ..... 1102158.1

(51) Int. Cl.
*G09F 1/10* (2006.01)
*G09F 23/06* (2006.01)
*G09F 13/18* (2006.01)

(52) U.S. Cl.
CPC ..... *G09F 1/10* (2013.01); *G09F 13/18* (2013.01); *G09F 23/06* (2013.01)

(58) Field of Classification Search
USPC ..... 40/124, 124.2, 124.4, 645, 649, 659, 40/642.02; 211/45
See application file for complete search history.

(56) References Cited

U.S. PATENT DOCUMENTS

| | | | | |
|---|---|---|---|---|
| 5,480,036 | A * | 1/1996 | Opar | 211/45 |
| 7,322,139 | B2 * | 1/2008 | Holcomb | G09F 1/14 248/469 |
| 7,765,729 | B2 | 8/2010 | Thurston | |
| 2009/0119958 | A1 | 5/2009 | Thurston | |

FOREIGN PATENT DOCUMENTS

| | | |
|---|---|---|
| CN | 2932536 | 8/2007 |
| CN | 200986776 | 12/2007 |

OTHER PUBLICATIONS

English Abstract of CN 2932536.
English Abstract of CN 200986776.
International Search Report for PCT Patent Application Serial No. PCT/EP2012/052140.

* cited by examiner

*Primary Examiner* — Joanne Silbermann
(74) *Attorney, Agent, or Firm* — Preston Smirman; Smirman IP Law, PLLC

(57) ABSTRACT

A holder (100) for a folded card (102), the folded card (102) being of the type having a spine (108) and at least two sheets (110). The holder (100) having a holder support (104) for engagement with a surface for preventing the holder (100) being disturbed in an outdoor environment and a card supporting arrangement (106) mounted on the holder support (104). The card supporting arrangement (104) having an assembly for supporting the spine (108) of the folded card (102) and for engaging at least a portion of the sheets (110) of the folded card (102) on opposing sides of the spine (108) holding the folded card (102) open at a pre-determined angle.

20 Claims, 7 Drawing Sheets

CARD HOLDER

CROSS-REFERENCE TO RELATED APPLICATION

The instant application is a national phase of PCT International Application No. PCT/EP2012/052140, filed on Feb. 8, 2012, and claims priority to GB Patent Application Serial No. 1102158.1, filed on Feb. 8, 2011, and U.S. Provisional Patent Application Ser. No. 61/469,290, filed on Mar. 30, 2011, the entire specifications of all of which are expressly incorporated herein by reference.

This invention relates to holder for a folded card, and in particular to a holder for a folded card that is able securely to hold the folded card in an open position in all weather conditions. The folded card can be a memorial or grave card, or similar.

Holders for folded cards are well known, but not all holders hold the folded card open at a fixed angle so that comments, sentiments, etc written or printed on the interior of the folded card may be easily read whilst preventing the folded card from being dislodged from the holder, particularly when used outdoors. Holders that are suitable only for indoor use may not remain upright on an uneven outdoor surface, and are affected by the wind, birds, animals, and the like if deployed outside. Some holders for outdoor use require special cards in order to engage with the holder.

Accordingly, the present invention provides a holder for a folded card, the folded card being of the type having a spine and at least two sheets, the holder comprising a holder supporting means for engagement with a surface for preventing the holder being disturbed in an outdoor environment and a card supporting means mounted on the holder supporting means, the card supporting means comprising means for supporting the spine of the folded card and means for engaging at least a portion of the sheets of the folded card on opposing sides of the spine holding the folded card open at a pre-determined angle.

Ideally, the card supporting means further providing upper and lower support means for the folded card at least at respective lower and upper edges of the sheets of the card.

Preferably, at least one of the upper and lower support means are movably mounted on the means for supporting the spine of the folded card.

Preferably, the card supporting means supports the card along the length of the spine.

The fact that the holder supporting means can be engaged with a surface prevents the holder from being disturbed, particularly in an outdoor environment. The fact that the folded card is supported above and below and along the spine means that the folded card is held in an open position at a fixed angle so that a message inside the folded card can be easily read whilst preventing the folded card from being dislodged from the holder, particularly when used outdoors.

Preferably, the card supporting means further comprises a first elongate support means for engaging an outward facing surface of the folded card about and away from a spinal portion thereof and a second elongate support means for engaging an inwards facing surface of the folded card about and away from a spinal portion thereof.

Advantageously, the folded card can be easily slid into the holder between the first and second elongate support means.

Preferably, the first and second elongate support means are releasably clamped together by clamp means at or about at least one end of the elongate support means.

Ideally, the first and second elongate support means are releasably clamped together by clamp means at or about both ends of the elongate support means.

Ideally, at least one of the clamp means is movably mounted on the elongate support means.

Preferably, at least one of the clamp means is slidably mounted on the elongate support means.

Ideally, the clamp means are provided by first and second plates at or about both ends of the elongate support means. This means that the folded card is not easily dislodged from the holder.

Preferably, at least one clamp means is removable from the elongate support means. Advantageously, the clamp means is removable to allow cards to be removed and/or replaced.

Ideally, at least one clamp means has at least one aperture formed for receiving the elongate support means.

Preferably, the first and second clamping plates are respectively locatable proximal the lower edge and the upper edge of the folded card. This means that the folded card is secured in a fixed position of the card holder in an open position.

In a first embodiment of elongate support means, the first and second elongate support means comprises respective first and second elongate angled sections.

Preferably, the first elongate angled section is nestable within the second elongate angled section forming a gap there between, the gap accommodating the folded card. This means that the spine and the parts of the sheets of the card extending out from the spine are supported in an elongate angled slot between the two elongate angled sections.

In a second embodiment of elongate support means, the first elongate support means comprises at least three vertical rods. This means that a larger proportion of the interior of the folded card is visible, and helps to maintain an airflow around the folded card to reduce rotting of the folded card when the holder is used outdoors.

In this second embodiment, the second elongate support means comprises at least three vertical rods. This means that a larger proportion of the exterior of the folded card is visible, and helps to maintain an airflow around the folded card to reduce rotting of the folded card when the holder is used outdoors.

In this second embodiment, the three vertical rods of the first and second elongate support means have a v-shaped configuration in plan view.

Preferably, the folded card is removably mounted on the card support means. This means that the holder can be left in place while one card is replaced with another.

Preferably, the holder supporting means is a ground spike. This allows the holder to be easily inserted in position.

In an alternative embodiment, the holder supporting means is provided by a plinth, strap or clamp.

Preferably, the holder supporting means is provided by any one of or any combination of a spike, plinth, strap or clamp.

Ideally, the plinth is manufactured from marble or similar material.

Preferably, the plinth has sufficient weight to support the card holder in a fixed position during inclement weather conditions.

Preferably, the holder is stabilised by attaching angled supports to the card support means.

Preferably, the folded card is waterproof. This prevents the folded card from becoming damaged by rain when the holder is used outdoors.

Preferably, the holder is fabricated of a material which does not corrode.

This means that the holder can be used outdoors over an extended period, and the folded card it holds does not become discoloured with corrosion products.

Preferably, the holder is lacquered to prevent corrosion.

The invention will now be described with reference to the accompanying drawings which show by way of example only two embodiments of a holder for a folded card in accordance with the invention. In the drawings.

Figure 1:
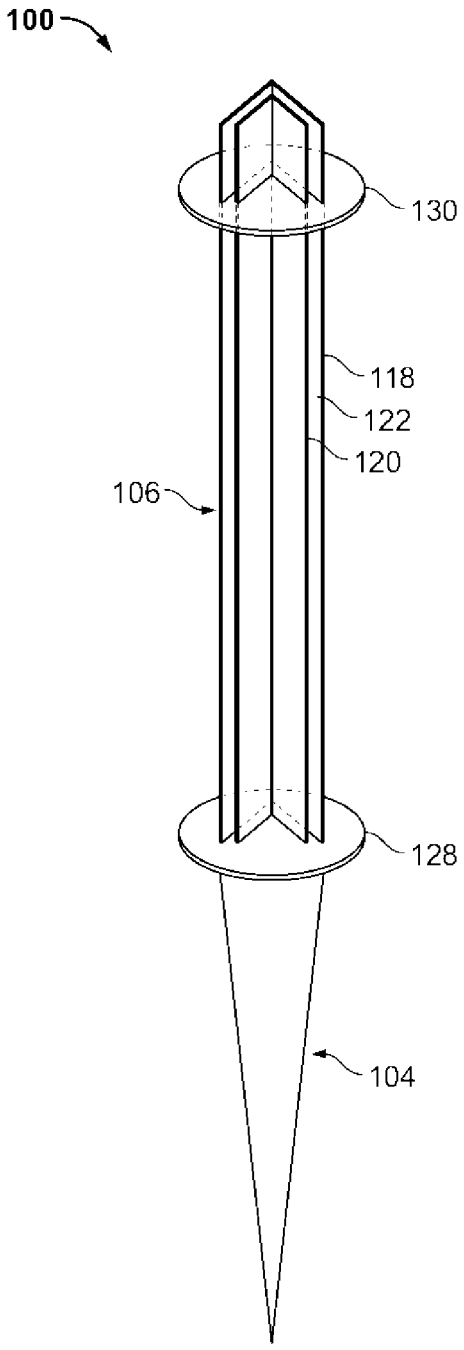
FIGS. 1 and 2 show perspective views of the first embodiment of holder for a folded card.

FIGS. 1 to 4 show a first and second embodiment of holder indicated generally by the reference numeral 100 for a folded card 102. The holder 100 can be securely engaged with a surface and the holder 100 enables the folded card 102 to be securely held in an open position whilst preventing the folded card 102 from being dislodged from the holder 100, particularly when used outdoors. Typically the folded card 102 is a memorial or grave card.

The holder 100 includes a holder support 104 for robustly securing the holder 100 to a suitable surface. The holder support 104 can be in the form of a spike which can be pushed into the ground. In an alternative arrangement of holder support not shown a plinth of substantial weight or a clamp arrangement for attaching the card holder 100 to a part of the grave can be used.

Figure 2:
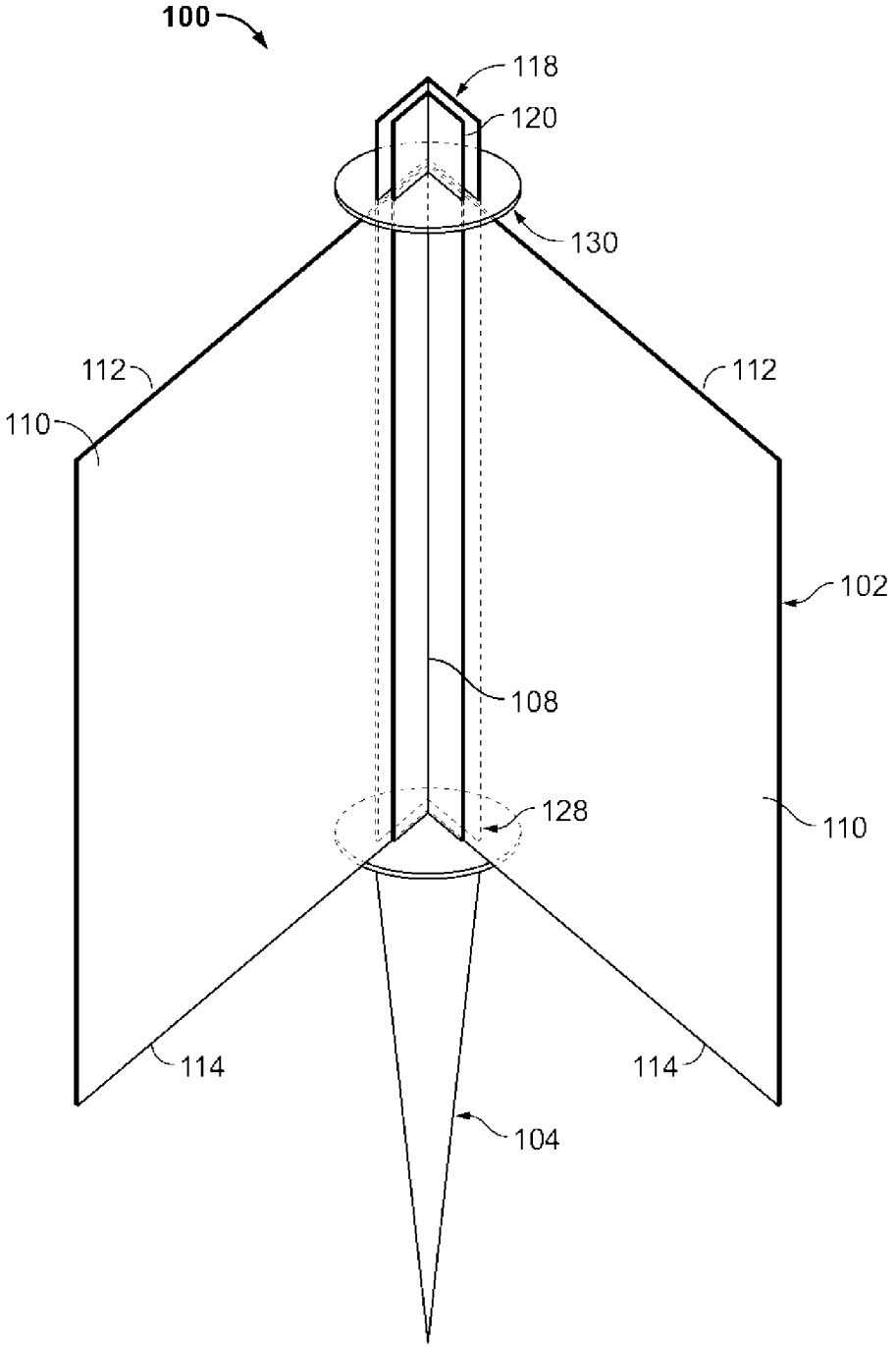
Figure 4:
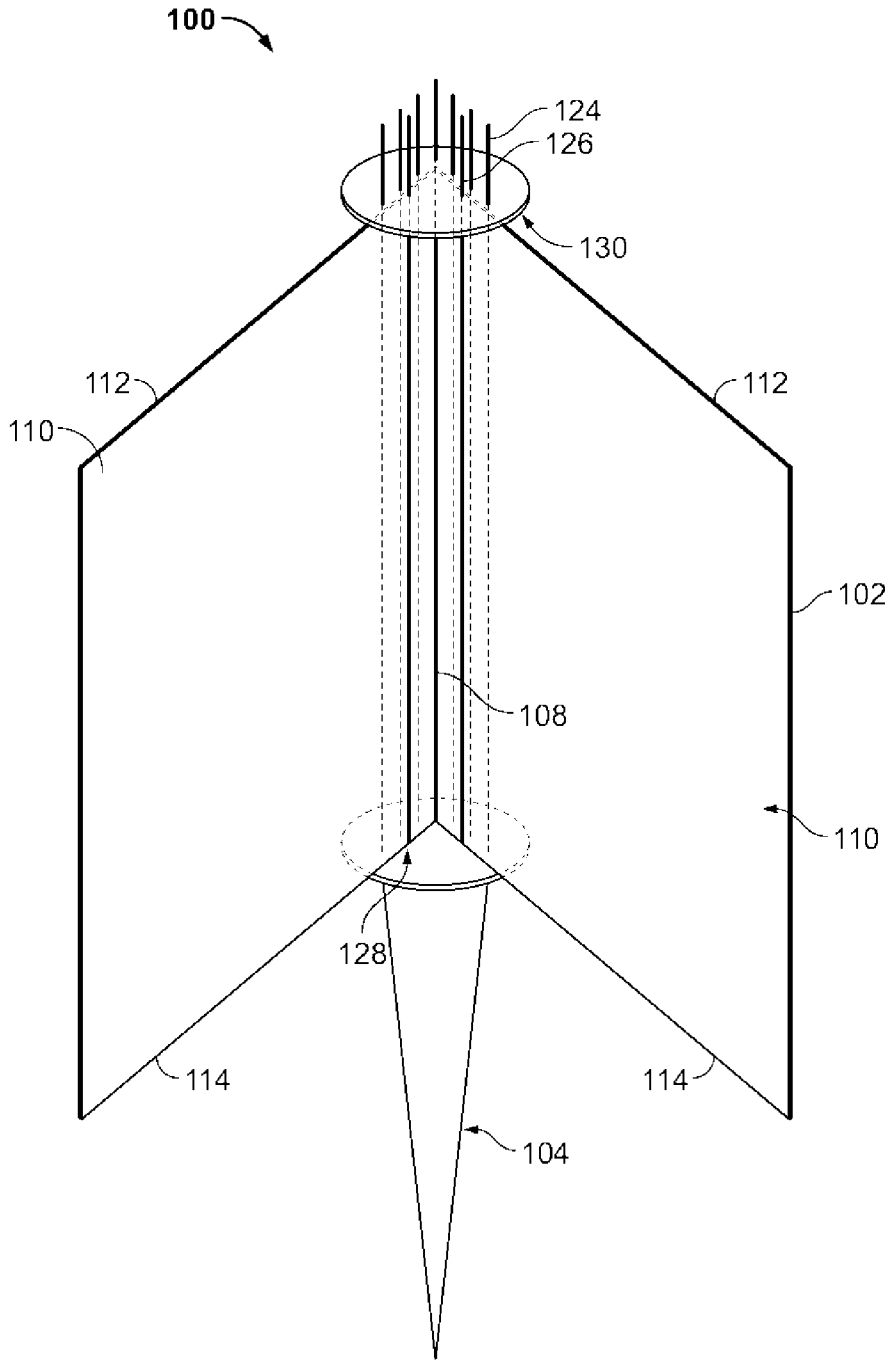

The holder 100 includes a card support arrangement 106 for holding the folded card 102 in an open position as shown in FIGS. 2 and 4. The folded card 102 comprises a spine 108 and sheets 110 on either side of the spine 108, the sheets 110 having upper edges 112 and lower edges 114.

Figure 3:
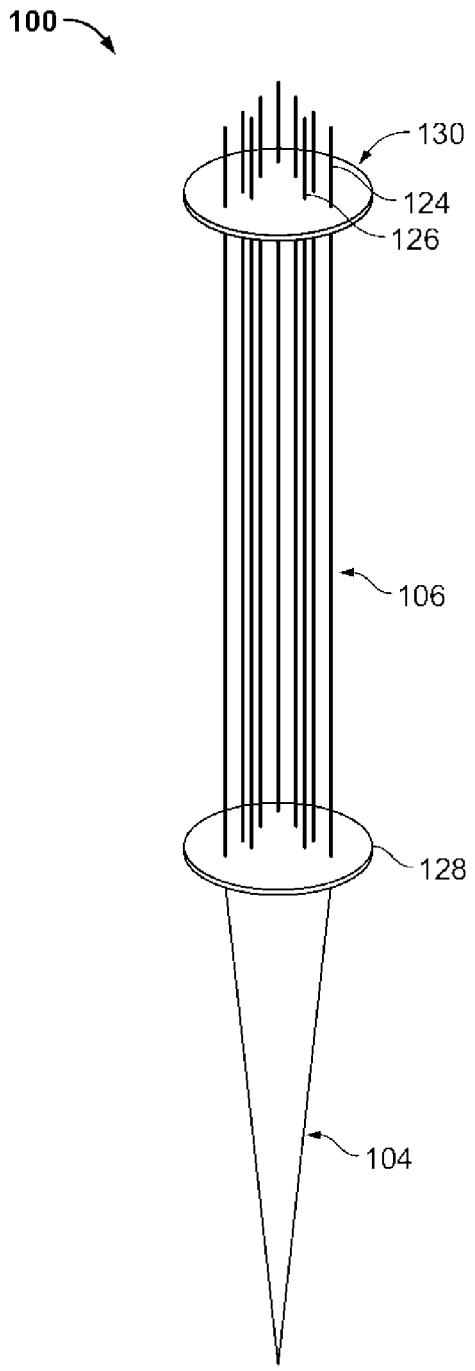
FIGS. 3 and 4 show perspective views of a second embodiment of the holder for a folded card.

The card support arrangement 106 is arranged so as to support the spine 108 along the entire length of the card spine 108 and to support the sheets 110 on either side of the spine 108 to hold the folded card 102 in an open position. The card support arrangement 106 comprises a first elongate support member 118 of FIGS. 1 and 2 and 124 of FIGS. 3 and 4 engaging an outward facing surface of the folded card 102 near the spine 108 and a second elongate support member 120 of FIGS. 1 and 2 and 126 of FIGS. 3 and 4 engaging an inwards facing surface of the folded card 102 near the spine 108. This means that the folded card 102 can be easily slid into the holder 100 between the two elongate support members 118 and 120 of FIGS. 1 and 2 or 124 and 126 of FIGS. 3 and 4. In FIGS. 1 and 2, the first and second elongate support members 118, 120 comprise a pair of elongate V-shaped sections 118,120 arranged so as to have a gap 122 between them. In FIGS. 3 and 4, the first and second elongate support members 124, 126 comprise a pair of V-shaped rows of rods 124, 126 arranged so as to have a gap 122 between the rows. The gap 122 allows the folded card 102 to be slid between the sections 118,120 or the rows 124,126, and the V-shape means that the folded card 102 is held in an open position at the acute angle between the two leg sections of the V-shape.

The card support 106 further comprises a first plate 128 to which the holder support 104 and the sections 118,120 or the rows 124,126 are attached. The holder support 104 can be releasably attached to the first plate 128 by fasteners or alternatively the holder support 104 can be permanently attached to the first plate 128 by welding or forming as a single component. One or both of the sections 118,120 or the rows 124,126 are releasably attachable to the first plate 128. The first plate 128 provides a support for the folded card 102 along at least part of a lower edge 114 of the folded card 102. The card support 106 further comprises a second plate 130 which engages with the sections 118,120 or the rows 124, 126 to provide support for the folded card 102 along at least part of an upper edge 112 of the folded card 102. This means that the folded card 102 is securely held about the spine 108 and portions of the sheets 110 lateral of the spine 108 between the two elongate support members 118 and 120 or 124 and 126 and securely held at the upper 112 and lower edges 114 of the holder 100 so that the card 102 may not be easily dislodged.

Figure 5:
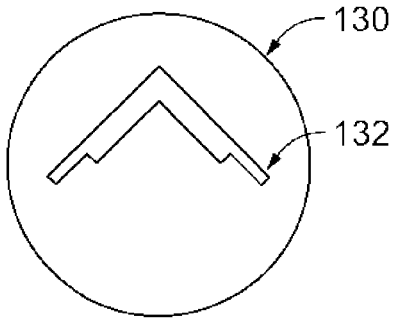
FIGS. 5 and 6 show plan views of two embodiments of clamp.
Figure 6:
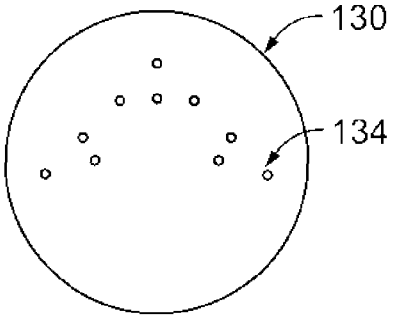

FIGS. 5 and 6 show one of the plates 130 adapted so as to engage the V-shaped sections 118,120 or rows 124,126 of the card support 106 to securely retain the folded card 102. In FIG. 5, the plate 130 has a V-shaped slot 132 which allows it to be pushed over and slidably moved along the V-shaped sections 118,120. In FIG. 6, the plate 130 has holes 134 corresponding to the V-shaped rows of rods 124,126 which allows it to be pushed over and slidably moved along the V-shaped rows of rods 124,126.

Figure 7:
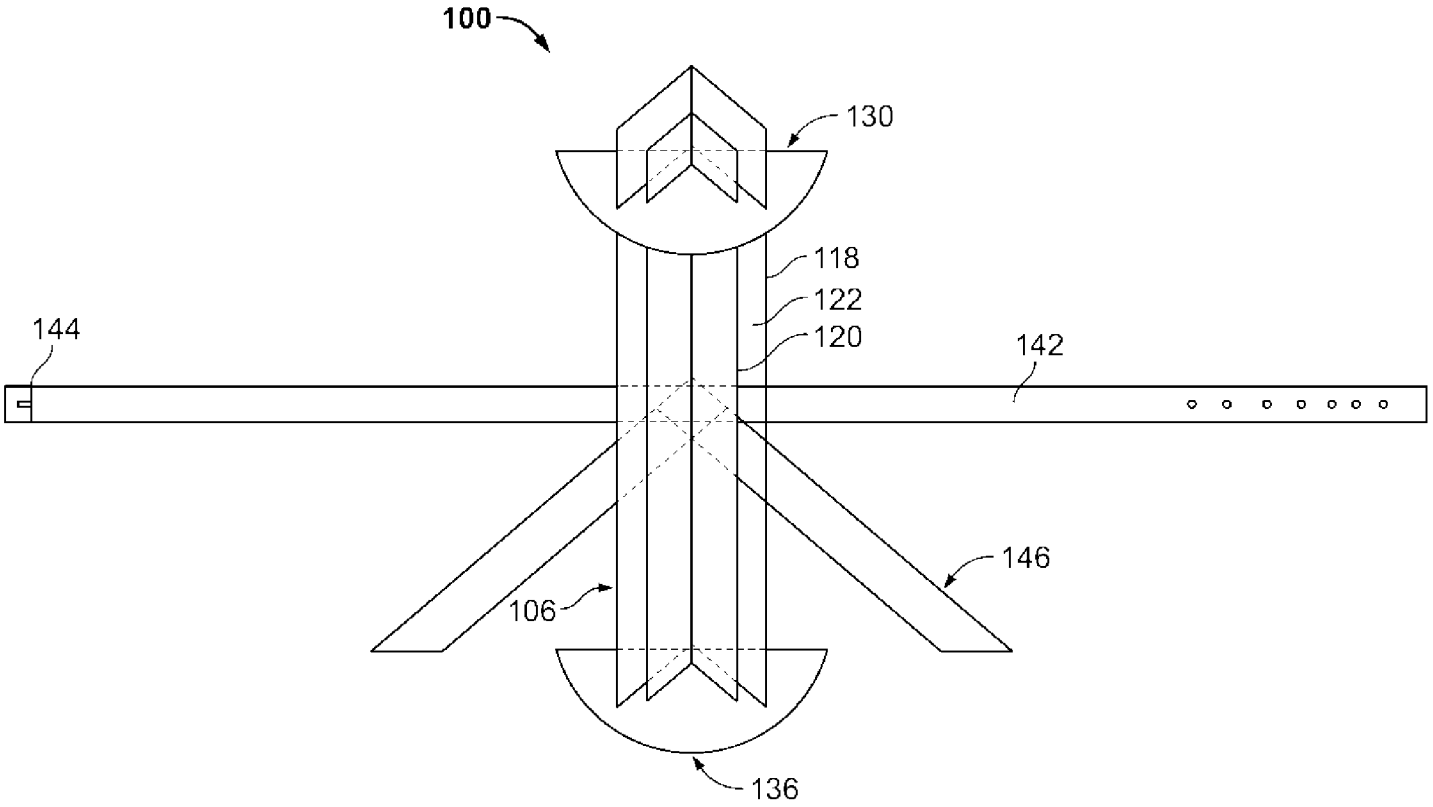
FIGS. 7, 8 and 9 show perspective, elevation, and plan views, respectively, of additional features to secure the holder for the folded card in place.
Figure 8:
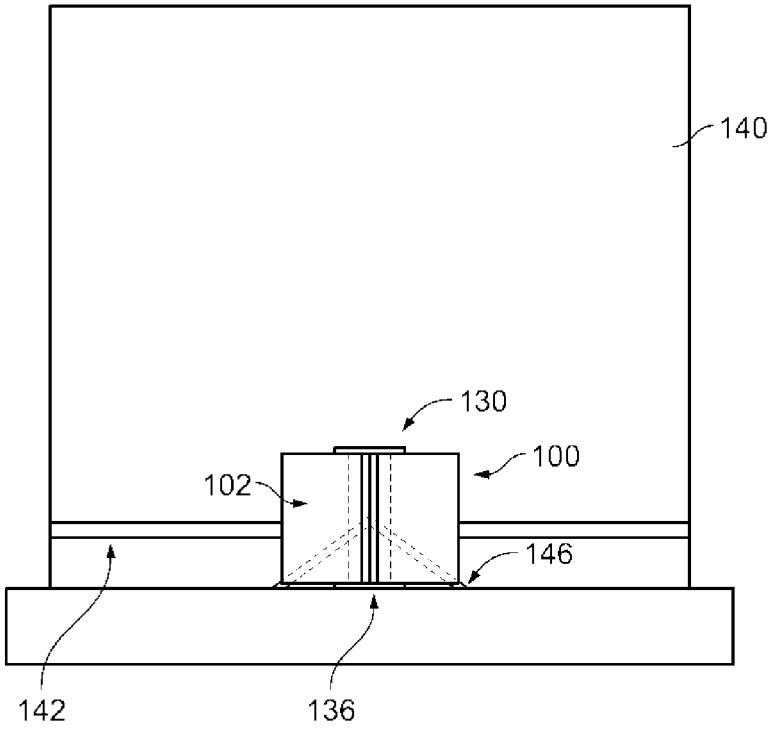
Figure 9:
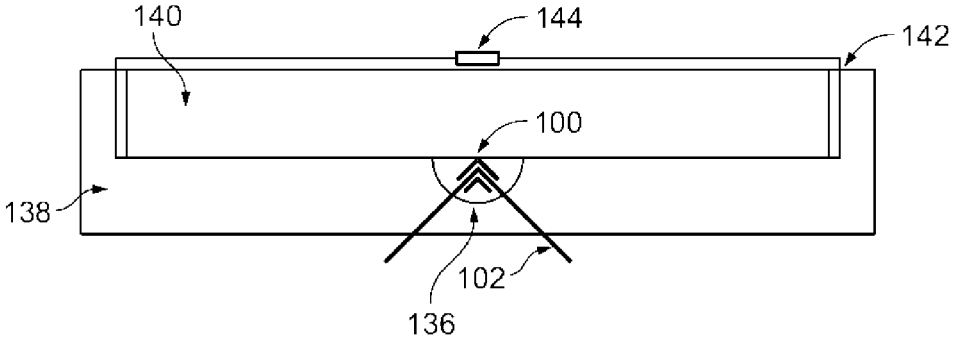

FIGS. 7 to 9 show a third embodiment of the present invention in which the holder support 104 and the first plate 128 are combined in the form of a base 136, which is able to rest on a flat surface, such as a grave headstone base 138. The base 136 may be semicircular to allow the flat diametric portion to abut a grave headstone 140.

A flexible strap or belt 142 is affixed to the card support 106, and is configured to be fastened around a grave headstone 140. The ends of the belt 142 have fasteners 144 in the form of a buckle, Velcro or other suitable arrangement. This means that the holder 100 can be firmly positioned on a grave headstone base 138, and a folded card 102 securely held by the holder 100 as described above.

The holder 100 may be further stabilised against tilting by attaching angled supports 146 to the card support 106.

In FIGS. 1 to 9, the folded card 102 may be waterproof, achieved for example, by encapsulating a folded card 102 in plastic, or having a folded card 102 comprising plastic. This prevents the folded card 102 from becoming damaged by rain or the atmosphere when the holder 100 is used outdoors.

The holder 100 can be fabricated from a material which does not corrode, such as a plastic. This means that the holder 100 can be used outdoors over an extended period, and the folded card 102 it holds does not become discoloured with corrosion products. Alternatively, the holder 100 is lacquered to prevent corrosion.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. A holder for a folded card, the folded card being of the type having a spine and at least two sheets, the holder comprising:

a holder supporting member for engagement with a surface for preventing the holder being disturbed in an outdoor environment and a card supporting member mounted on the holder supporting member, the card supporting member supporting the spine of the folded card and engaging at least a portion of the sheets of the folded card on opposing sides of the spine holding the folded card open at a pre-determined angle;

wherein the card supporting member further comprises a first elongate support member for engaging an outward facing surface of the folded card about and away from a spinal portion thereof and a second elongate support member for engaging an inwards facing surface of the folded card about a spinal portion thereof;

wherein the card supporting member further comprises a first plate to support the folded card along at least part of a lower edge of the sheets of the card, the first plate being attached to the holder supporting member.

2. The holder as claimed in claim 1, wherein the card supporting member further comprises a second plate to support the folded card along at least part of an upper edges of the sheets of the card.

3. The holder as claimed in claim 2, wherein the first and second plates are respectively locatable proximal the lower edge and the upper edge of the folded card.

4. The holder as claimed in claim 2, wherein the second plate is attached to the first elongate support member.

5. The holder as claimed in claim 2, wherein the second plate is releasably attached to the second elongate support member.

6. The holder as claimed in claim 1, wherein the card supporting member supports the card along the length of the spine.

7. The holder as claimed in claim 1, wherein the first and second elongate support members comprise respective first and second elongate angled sections.

8. The holder as claimed in claim 7, wherein the first elongate angled section is nestable within the second elongate angled section forming a gap there between, the gap accommodating the folded card.

9. The holder as claimed in claim 1, wherein the first elongate support member comprises at least three vertical rods.

10. The holder as claimed in claim 9, wherein the second elongate support member comprises at least three vertical rods.

11. The holder as claimed in claim 1, wherein either the first or second elongate support members comprise at least three vertical rods, wherein the three vertical rods of the first and second elongate support members have a v-shaped configuration in plan view.

12. The holder as claimed in claim 1, wherein the holder is fabricated from a non-corrosive material.

13. The holder as claimed in claim 1, wherein the holder is lacquered to prevent corrosion.

14. The holder as claimed in claim 1, wherein the folded card is removably mounted on the card support member.

15. The holder as claimed in claim 14, wherein the folded card is waterproof.

16. The holder as claimed in claim 1, wherein the holder supporting member is selected from the group consisting of a ground spike, plinth, strap, clamp, and combinations thereof.

17. The holder as claimed in claim 1, wherein the first plate is releasably attached to the holder supporting member.

18. The holder as claimed in claim 1, wherein the first plate is permanently formed with the holder supporting member.

19. The holder as claimed in claim 1, wherein the first plate is attached to the first elongate support member.

20. The holder as claimed in claim 1, wherein the first plate is releasably attached to the second elongate support member.

* * * * *